US006469610B1

(12) United States Patent
Chen

(10) Patent No.: US 6,469,610 B1
(45) Date of Patent: Oct. 22, 2002

(54) SWITCH ASSEMBLY

(75) Inventor: Chun-Hsu Chen, Pan-Chiao (TW)

(73) Assignee: Tsung-Mou Yu, Panchiao (TW)

( * ) Notice: Subject to any disclaimer, the term of this patent is extended or adjusted under 35 U.S.C. 154(b) by 90 days.

(21) Appl. No.: 09/627,349

(22) Filed: Jul. 28, 2000

(51) Int. Cl.[7] ..... H01H 71/16
(52) U.S. Cl. ..... 337/66; 200/553; 337/70
(58) Field of Search ..... 200/553–562, 200/313–315, 339, 18; 337/66, 37–65, 67–79

(56) References Cited

U.S. PATENT DOCUMENTS 4,661,667 A * 4/1987 Sorimachi et al. ..... 200/313
4,704,594 A * 11/1987 Krasser ..... 337/66
4,931,762 A * 6/1990 Fierro ..... 337/66
4,937,548 A * 6/1990 Sdunek ..... 337/66 X
5,223,813 A * 6/1993 Cambreleng et al. ... 200/339 X
5,451,729 A * 9/1995 Onderka et al. ..... 200/18
5,786,742 A * 7/1998 Yin ..... 337/66
6,323,450 B1 * 11/2001 Chen ..... 200/553

* cited by examiner

*Primary Examiner*—J. R. Scott

(57) ABSTRACT

A switch assembly comprises a switch knob, a contact control member, a resilient contact piece and a bimetal alloy leaf for automatically cutting off power supply when current overload occurs. The switch knob is depressed to drive a protuberance to directly press or release the contact control member and the resilient contact piece to connect or cut off the power supply in normal operation. When current overload occurs, the bimetal alloy leaf deformed to push a moveable rod of the contact control member to release the resilient contact piece for cutting off the power supply. The switch assembly also includes a resilient member for restoring the contact control member to a normal off state after cutting off the power supply.

6 Claims, 5 Drawing Sheets

SWITCH ASSEMBLY

BACKGROUND OF THE INVENTION

1. Field of the Invention

This invention relates generally to a switch assembly and, more particularly, it relates to a switch assembly built with a simple control circuit and an associated thermal-sensitive alloy leaf for cutting off power supply automatically in case of overload so as to ensure safety.

2. Description of the Prior Art

A power switch is a widely used electronic component for ON/OFF control of a power supply, and is highlighted in its structural complexity in consideration of cost, and particularly, of its reliability of safety.

A generic power switch is a manipulative switch. In some districts where electric power lacks stability, unexpected overload may occur occasionally to bring about overheat that could possibly result in public dangers.

For the improvement of a switch assembly, many patents, such as U.S. Pat. No. 5,786,742, 5,223,813, 4,937,548, 4,661,667, 4,931,762, 5,451,729, and 4,709,594 have been disclosed, wherein a bimetal thermal-sensitive element is implemented for cutting off power supply automatically in case of overload.

For example, the U.S. Pat. No. 4,937,548 has disclosed a mechanism including a bimetal piece, a lever controlled by the bimetal piece, and a cam associated with a see-saw member for controlling contact or separation of two conductive plates and for displacing the lever when the bimetal is heated and deformed to thereby remove the support of the cam to cut off the power supply. Whereas, the bimetal is to react to the overload current directly while the conductive plates are separated by indirect interaction through the bimetal, the cam, and the see-saw member in a somewhat abrupt response with possible malfunctions. Hence, there is still some time for the overload current to pass through an electric appliance and destroy it instantaneously. In addition, it requires an extra wire for connection of the conductive plate and the bimetal to complicate the structure.

In the U.S. Pat. No. 5,786,742, deformation of an overheated alloy leaf drives a limit seat to have a switch knob escaped and reset. However, the contact points could probably contact with each other when overloading occurs because the switch knob drives one of the contact points directly. Therefore, there is a need in improving the abrupt response and complicated structure of a switch although the above patents can solve the overload problem in one way or another.

SUMMARY OF THE INVENTION

The primary object of this invention is to provide a switch assembly comprising a switch knob, a contact control member, and an alloy leaf for cutting off power supply rapidly to ensure safety in the event of overload.

Another object of this invention is to provide a switch assembly with simple interactive mechanism by means of a protuberance of a switch knob, wherein the protuberance oppresses or release a contact control member directly to enable the latter to in turn oppress or release a resilient member to connect or cut off a power supply.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
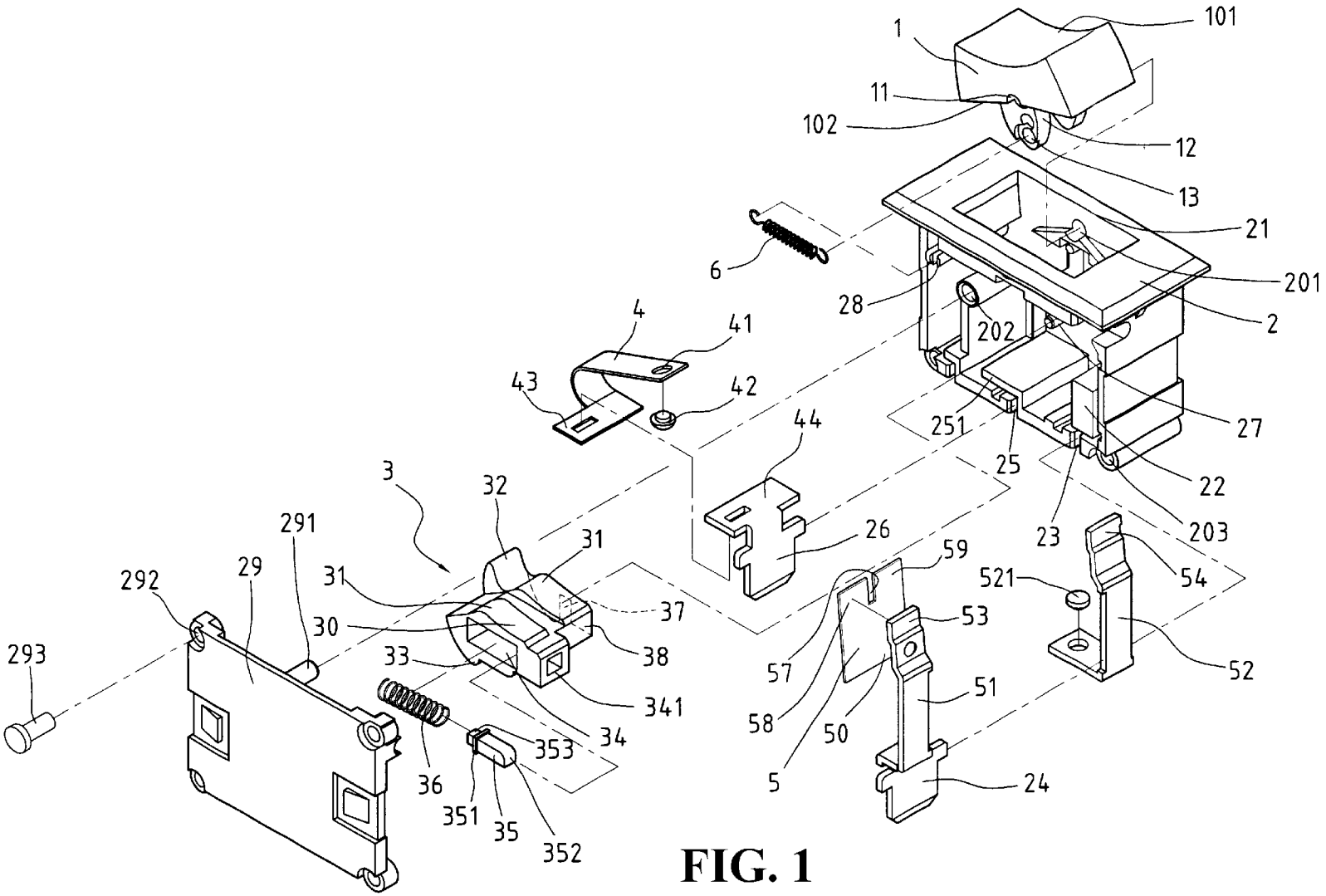
FIG. 1 is an exploded view of an embodiment of this invention in three dimensions.

As illustrated in FIG. 1, a switch assembly of this invention mainly comprises a switch knob 1, a casing 2, a contact control member 3, a resilient contact piece 4, an alloy leaf 5, and a resilient member 6.

In the switch knob 1, a dipped arcuate face is formed on the top end 101. An axle-supporting groove 11 concavely and centrally disposed at the bottom end 102 of the switch knob 1 serves as a pivot center to enable the switch knob 1 to rotate. The bottom end 102 of the switch knob 1 is further extended downwardly to form at least a protuberance 12, which, in this case, is substantially a triangular protrusion with a through hole 13.

The case 2 is a hollow housing having an open lateral wall, wherein an opening 21 is formed at the top end of the casing 2. An axle-supporting rod 201 is protrusively formed on an inner wall under the opening 21 for assembling and disposing the switch knob 1 to the axle-supporting groove 11. First and second slots 23,25 are arranged in the bottom end of the casing 2 for plugging first and second terminals 24,26 respectively. A hollow combination column 202, a stopper 22, a stationary supporting pin 27, and a protruding post 28 are protrusively fitted on the inner wall. A plurality of combination holes 203 is distributed to corners of the inner wall. Moreover, a cover 29 is provided to the casing 2, wherein an assembling post 291 in a position corresponding to the hollow combination column 202 is protuberantly disposed on an inner wall of the cover 29. A plurality of combination holes 292 in positions corresponding to the combination holes 203 of the casing 2 is distributed to the corners of the cover 29 that is riveted to joint with the casing 2 with a plurality of rivets 293.

In the contact control member 3, at least an upper lump 31 is located on the top end 30 of the contact control member 3. The top end 30 is extended to form a hook portion 32. At least a lower lump 33 is formed at the bottom end of the contact control member 3 in a position substantially corresponding to the upper lump 31. A first slot 34 having a slot opening 341 at a tail end is concavely disposed in a lateral face of the contact control member 3 and a movable rod 35 is assembled in the slot opening 341. Furthermore, a flange 351 annularly encloses the pillar body of the movable rod 35 at a nearer end 353, and the farther end is a propping end 352. The end face of the movable rod 35 is slightly smaller than the mouth area of the slot opening 341. A resilient component 36 (a compressible spring in this case) is assembled and disposed in the first slot 34 to enable the movable rod 35 to relatively stretch or shrink in the slot opening 341 within a range limited by the flange 351. A upright longitudinal second slot 37 is trenched in an opposite lateral face 38 of the contact control member 3 for assembling and jointing the contact control member 3 to the stationary supporting pin 27 of the casing 2.

The resilient contact piece 4 is provided with a jointing hole 41 at its upper free end for combining with an upper contact dot 42 which is located right above a lower contact dot 521 of an L-shaped second-circuit link rod 52. The lower end 43 of the contact piece 4 is a flat sheet coupled with an upper end 44 of the second terminal 26, and is fixedly clamped between a fixing plate 251 and a sole plate of the casing 2.

The alloy leaf 5 (thermal-sensitive element) is a metallic sheet 5 with a slit 57 at its top end, wherein two top ends 58, 59 standing aside the slit 57 are joint terminals. The lower part of the alloy leaf 5 is a free end 50, wherein one top end 58 beside the slit 57 is fixedly jointed with an upper end 53 of a first circuit link member 51. A lower end of the link member 51 is coupled with the first terminal 24 and a top end 59 beside the slit 57 is fixedly jointed to the top end 54 of the second circuit link member 52.

Moreover, one end of the resilient member 6 (a stretchable spring in this case) is connected with the protruding post 28 and the other end is hooked in the through hole 13 of the protuberance 12.

The operational states of the switch assembly of this invention include OPEN (OFF) state, CLOSE (ON) state, and automatic cutoff in case of OVERLOAD, which are to be described below.

Figure 2:
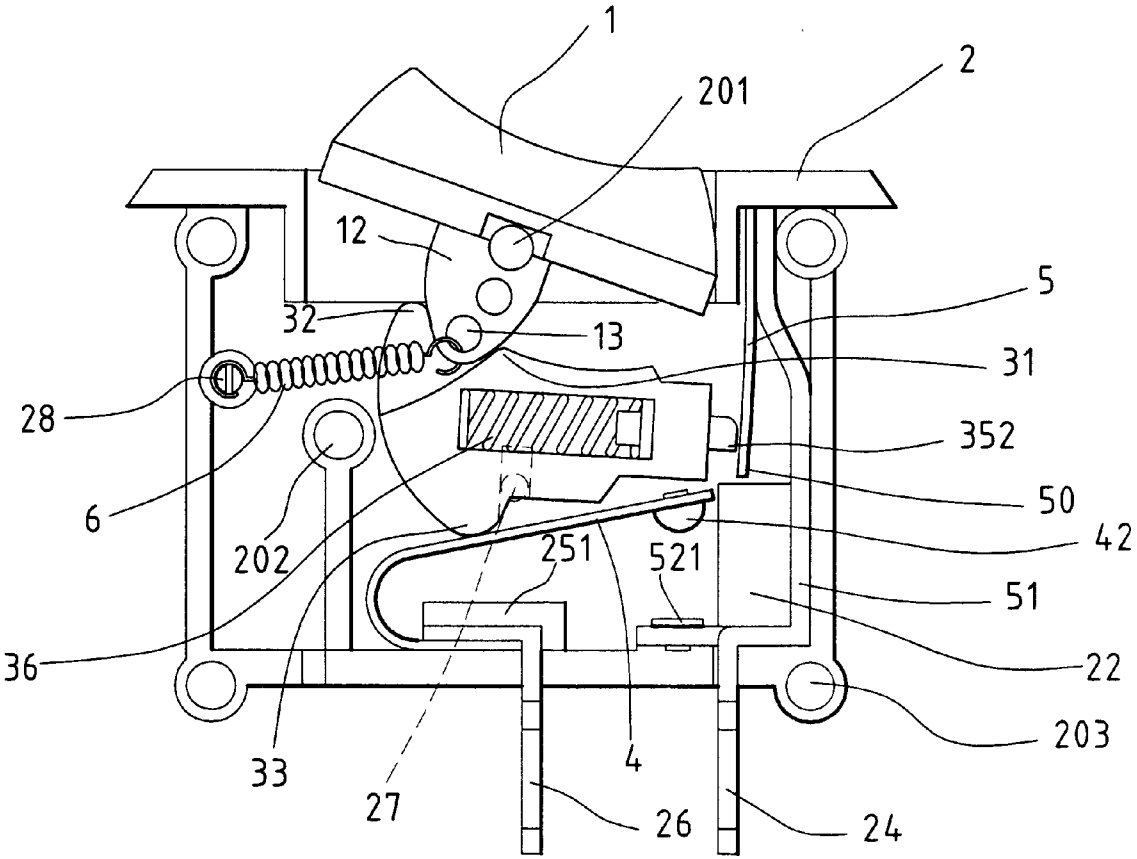
FIG. 2 is a cutaway sectional view showing the embodiment of this invention under OPEN (OFF) state.

As shown in FIG. 2, an assembled cutaway sectional view of an embodiment of this invention under OPEN (OFF) state controlled by a user is illustrated. When the user depresses the right end of the switch knob 1, the resilient member 6 is pressed leftward at the moment the switch knob 1 is forced to rotate clockwise around the axle-supporting rod 201 which is taken as a pivot. Simultaneously, taking the axle-supporting rod 201 as a pivot, the protuberance 12 rotates clockwise in an arcuate movement (leftward in this case), and the bottom end of the protuberance 12 slides from the right side of the upper lump 31 of the contact control member 3 to the left side of the upper lump 31. Therefore, the resilient contact piece 4 is freed from constraint of the lower lump 33 of the contact control member 3 to bounce upwardly and allow the upper contact dot 42 to depart from the lower contact dot 521 so as to separate the first terminal 24 from the second terminal 26 and cut off the power supply accordingly.

Figure 3:
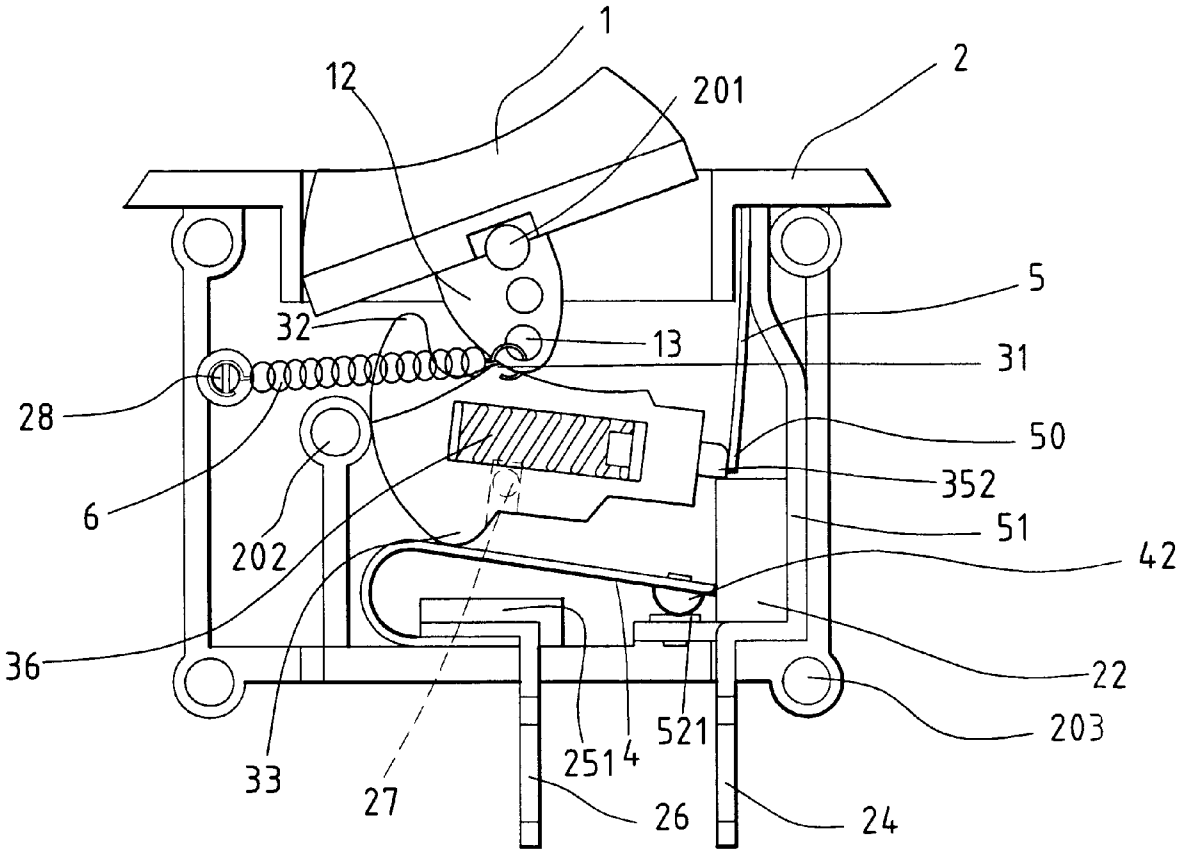
FIG. 3 is a cutaway sectional view showing the embodiment of this invention under CLOSE (ON) state.

FIG. 3 shows an assembled cutaway sectional view of the embodiment of this invention under CLOSE (ON) state. When a user depresses the left end of the switch knob 1, the resilient member 6 is stretched rightward to build a leftward restoring force at the moment the switch knob 1 is forced to rotate counterclockwise. The protuberance 12 also has counterclockwise movement (rightward in this case) by taking the axlesupporting rod 201 as a pivot. Simultaneously, the bottom end of the protuberance 12 slides from the left side of the upper lump 31 of the contact control member 3 to the right side to depress the contact control member 3 downwardly to have the lower lump 33 push against the resilient contact piece 4. Consequently, the upper contact dot 42 at the bottom face of the free end of the resilient contact piece 4 contacts the lower contact dot 521 to thereby form a current path for the power supply to go through the first terminal 24, the first circuit link member 51, the alloy leaf 5, the second circuit link member 52, the lower contact dot 521, the upper contact dot 42, the resilient contact piece 4, and the second terminal 26.

A highlight to be stressed herein is that under OPEN (OFF) state of the switch, the propping end 352 of the movable rod 35 of the contact control member 3 is located exactly over the top face of the stopper 22 of the casing 2. On the contrary, the propping end 352 props against the top face of the stopper 22 under CLOSE (ON) state, and the movable rod 35 itself does not stretch or shrink at all to keep its bottom face always on or above the top face of the stopper 22.

Figure 4:
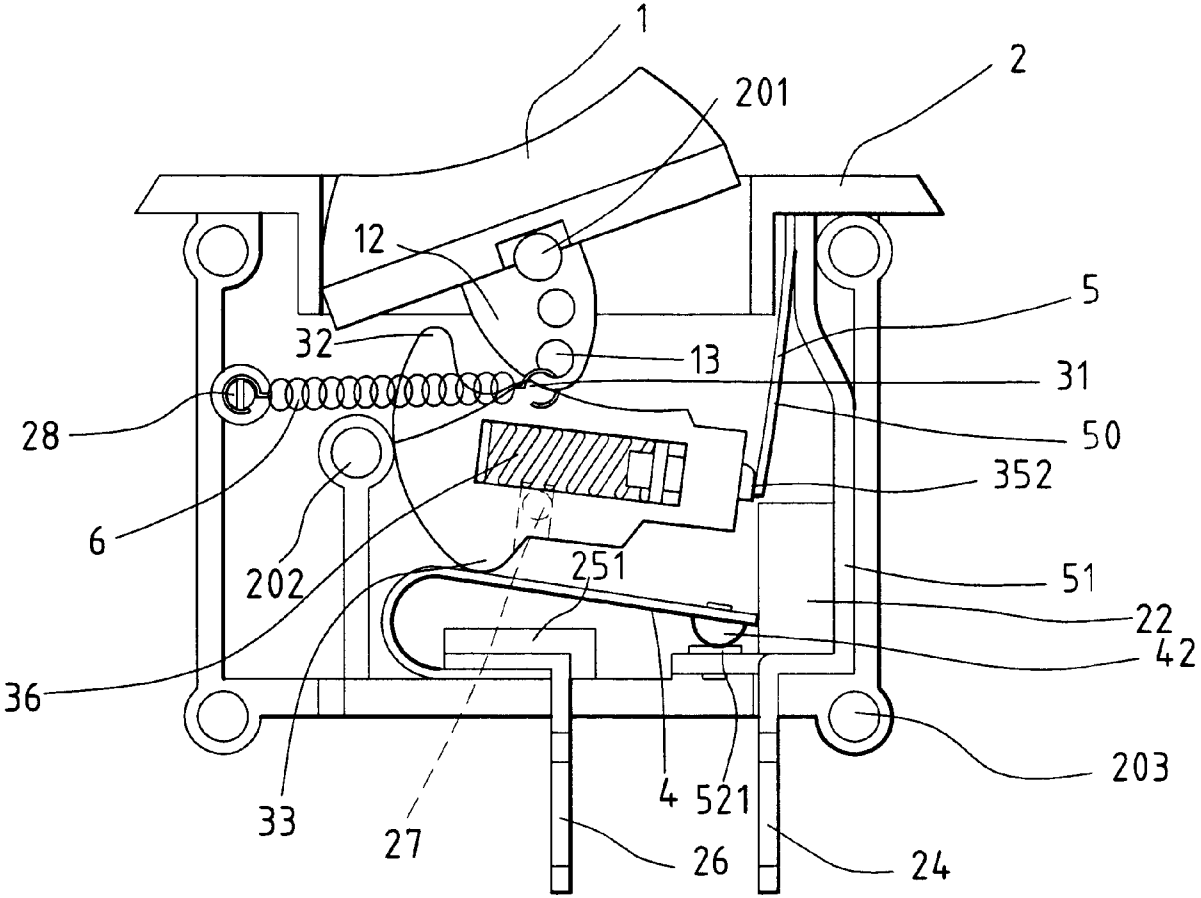
FIG. 4 is a cutaway sectional view of the embodiment of this inventiion showing response of an alloy leaf in case of overload.
Figure 5:
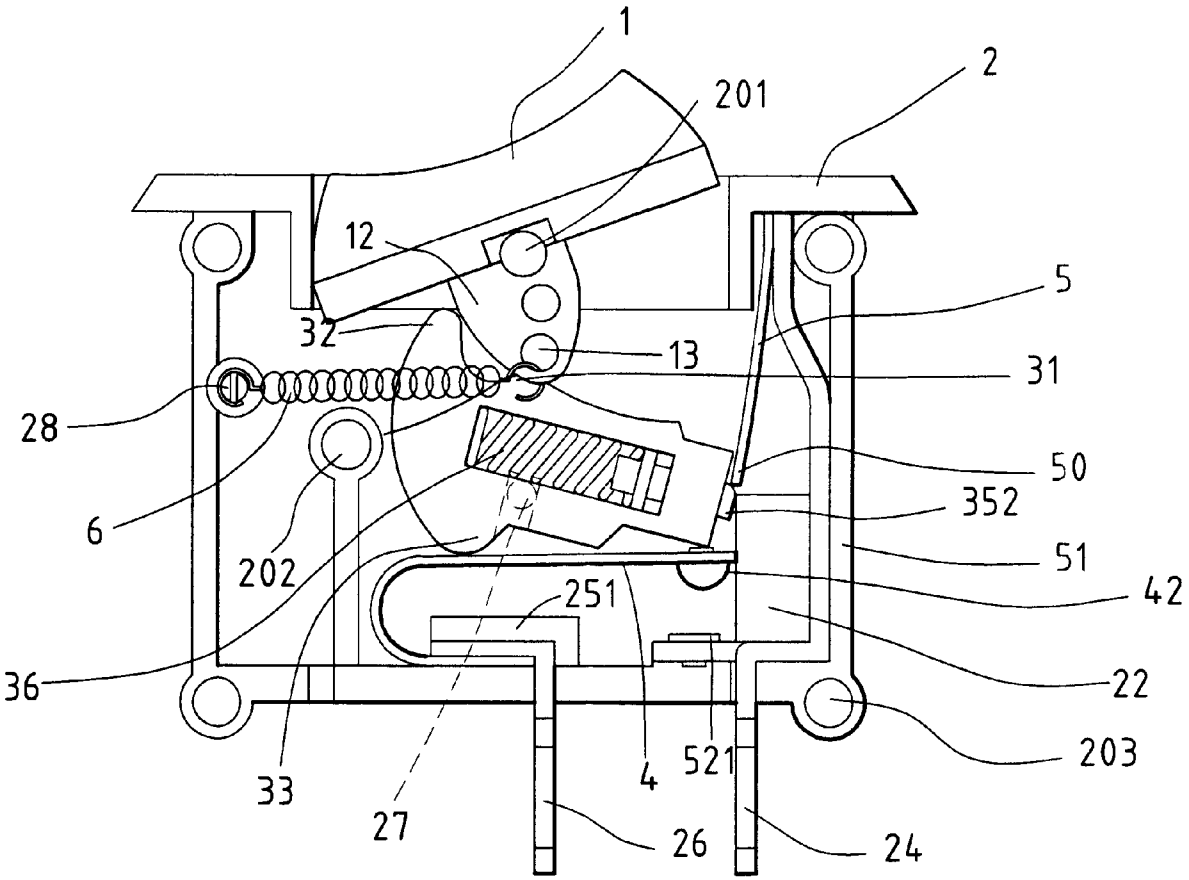
FIG. 5 is a cutaway sectional view of the embodiment of this invention illustrating that a contact control member drops to cut off power supply in case of overload.

According to a diagram of an alloy leaf of this invention in case of overload shown in FIG. 4, the free end 50 of the alloy leaf 5 will extend in a predetermined direction constantly (leftward in this case) because of the heat created when overloading occurs. The alloy leaf pushes the propping end 352 of the movable rod 35 to retreat and depart from the top face of the stopper 22 until the movable rod 35 together with the right end of the contact control member 3 drops downward in lack of support of the stopper 22. As soon as the movable rod 35 leaves the stopper 22, the lower lump 33 under the contact control member 3 rotates clockwise by taking the stationary supporting pin 27 in the second slot 37 as a pivot to allow the upper contact dot 42 at the free end of the resilient contact piece 4 to escape from the lower contact dot 521 and thereby cut off the power supply.

Meanwhile, at the moment the movable rod 35 drops, the resilient component (the compressible spring) 36 in the first slot 34 of the contact control member 3 is restored to stretch until it is stopped by the flang 351 of the movable rod 35 so that the movable rod 35 is reset to have its farther end emerged form the slot opening 341 as usual.

Under this circumstance, if no external force is applied onto the left end of the switch knob 1, the resilient member (the stretchable spring) retreats to pull the lower end of the protuberance 12 leftward, and the switch knob 1 is driven to rotate clockwise by taking the axle-supporting rod 201 as a pivot and stop at the OPEN (OFF) position as shown in FIG. 2. At this moment, the farther end of the resilient contact piece 4 is propping upwardly against the contact control member 3. After the alloy leaf 5 is cooled, the free end 50 is restored to its initial state and the bottom face of the propping end 352 of the movable rod 35 will again rest on or above the top face of the stopper 22 to enter the OPEN (OFF) state shown in FIG. 2 pending a next triggering.

In summary, the present invention takes advantage of the alloy leaf 5 and the contact control member 3 for automatic control of power supply cutoff in case of overload. The switch assembly also returns to stand-by state and direct contact between the switch knob 1 and the contact control member 3 without malfunction. The switch assembly of this invention can be operated reliably with a simple structure and relatively lower cost.

Although, this invention has been described in terms of preferred embodiments, it is apparent that numerous variations and modifications may be made without departing from the true spirit and scope thereof, as set forth in the following claims.

What is claimed is:

1. A switch assembly comprising:

a casing having a top opening and an inner wall formed with at least an axle supporting rod;

a switch knob having a bottom end formed with at least an axle supporting groove, and a protuberance extended downwardly from said bottom end, said switch knob being received through said top opening by said casing with said axle supporting groove supported by said axle supporting rod;

a resilient member having a first end affixed on said casing and a second send coupled to a through hole formed on said protuberance of said switch knob;

a contact control member having a top end formed with a hook portion and at least an upper lump, a bottom end formed with at least a lower lump, a lateral side formed with an assembling slot with a slot opening at a tail end of said contact control member, a resilient component disposed in said assembling slot, and a movable rod coupled to said resilient component and disposed in said slot opening, said contact control member being disposed within said casing and said movable rod having a propping end protruded through said slot opening and supported by a stopper disposed in said casing;

a thermal-sensitive alloy leaf disposed within said casing and connected to first and second circuit link members, said movable rod being pushed by said resilient component against said thermal-sensitive alloy leaf, a first terminal coupled to said second circuit link member through said first circuit link member and said thermal-sensitive alloy leaf, said second circuit link member being formed with a lower contact dot; and a resilient contact piece having a lower portion coupled to a second terminal, and an upper portion having a free end formed with an upper contact dot, said resilient contact piece being disposed below said contact control member;

wherein said switch assembly is operated in an OFF state by depressing a first side of said switch knob to rotate said protuberance clockwise for engaging with said hook portion of said contact control member to raise said upper portion of said resilient contact piece and disconnect said upper contact dot from said lower contact dot; said switch assembly is operated in an ON state by depressing a second side of said switch knob to rotate said protuberance counter clockwise for disengaging from said hook portion of said contact control member to lower said upper portion of said resilient contact piece and connect said upper contact dot to said lower contact dot; and said thermal-sensitive alloy leaf is thermally deformed to push said movable rod off said stopper to raise said upper portion of said resilient contact piece and disconnect said upper contact dot from said lower contact dot and said protuberance is pulled clockwise by said resilient member to restore said switch assembly to an OFF state when said switch assembly is overloaded or overheated in an ON state.

2. The switch assembly as claimed in claim 1, wherein said resilient member is a stretchable spring.

3. The switch assembly as claimed in claim 1, further comprising an upright longitudinal slot formed in said contact control member and a stationary supporting pin disposed in said casing, wherein said stationary supporting pin is positioned within said upright longitudinal slot and said contact control member is movably constrained upwards or downwards by said upright longitudinal slot.

4. The switch assembly as claimed in claim 1, wherein said movable rod has one end formed with a flange for coupling to said resilient component.

5. The switch assembly as claimed in claim 1, wherein said thermal-sensitive alloy leaf has two top ends fixedly jointed to upper ends of said first and second circuit link members respectively.

6. The switch assembly as claimed in claim 1, wherein said resilient component is a compressible spring.

* * * * *